US006742856B2

(12) United States Patent
Tatsumi

(10) Patent No.: US 6,742,856 B2
(45) Date of Patent: Jun. 1, 2004

(54) MOVEMENT CONTROL APPARATUS, PRINTING APPARATUS, AND MOVEMENT CONTROL METHOD

(75) Inventor: Shingo Tatsumi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 10/094,808

(22) Filed: Mar. 12, 2002

(65) Prior Publication Data

US 2002/0158935 A1 Oct. 31, 2002

(30) Foreign Application Priority Data

Mar. 16, 2001 (JP) ..... 2001-076549

(51) Int. Cl.[7] ..... B41J 29/393; B41J 23/00; B41J 21/16; B41J 29/18

(52) U.S. Cl. ..... 347/19; 347/37; 400/279; 400/705

(58) Field of Search ..... 347/19, 37, 14; 400/279, 320, 705, 705.1

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,873,663 A | | 2/1999 | Yokoi et al. | 400/279 |
| 6,422,682 B1 | * | 7/2002 | Kaneko et al. | 347/37 |

FOREIGN PATENT DOCUMENTS

| | | | |
|---|---|---|---|
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |

* cited by examiner

*Primary Examiner*—Juanita Stephens
(74) *Attorney, Agent, or Firm*—Fitzpatrick, Cella, Harper & Scinto

(57) ABSTRACT

To control movement of a member to be driven by using a scale having a plurality of indices at a predetermined interval, and a sensor which is attached to the member to be driven along the scale and detects the indices, a time until the next index is detected is predicted on the basis of the output waveform of the sensor. Then, a signal concerning the current position of the member is generated on the basis of the predicted time. The current position of the member can be controlled with high precision even during acceleration/deceleration.

9 Claims, 7 Drawing Sheets

MOVEMENT CONTROL APPARATUS, PRINTING APPARATUS, AND MOVEMENT CONTROL METHOD

FIELD OF THE INVENTION

The present invention relates to a movement control apparatus, printing apparatus, and movement control method and, more particularly, to control of the current position of a member to be driven by using an encoder having a scale equipped with a plurality of indices at a predetermined interval and a sensor which is attached to the member driven along the scale and detects an index.

BACKGROUND OF THE INVENTION

Printers for printing desired information such as characters or images on a sheet-like printing medium such as a paper sheet or film are widely used as an information output apparatus for a word processor, personal computer, or a facsimile apparatus.

The printing method of the printer includes various methods. An ink-jet method has recently received a great deal of attention because it can perform non-contact printing on a printing medium such as a paper sheet, can easily print a full-color image, and is quiet. As an ink-jet arrangement, a serial printing method is generally widely used in terms of low cost and easy downsizing. In the serial printing method, a printing head for discharging ink in accordance with desired printing information is mounted on a carriage. Information is printed by reciprocally scanning the carriage in a direction perpendicular to the feed direction of a printing medium such as a paper sheet (main scanning).

In recent years, high-resolution serial printers have been available along with the development of the printing technique. In this high-resolution printer, the precision of position information in the main scanning direction greatly influences the printing quality.

As for the printer performance, demands have arisen for higher printing speed in addition to higher printing resolution. Higher-speed, higher-resolution printers have been commercially available year after year.

To increase the printing speed, the moving speed in the main scanning direction must be increased. As the speed increases, the precision of position information necessary for high-resolution printing degrades.

To prevent this, there are proposed many printers using so-called encoders in order to accurately acquire position information. This encoder outputs the index of the absolute position of a printing head-mounted carriage in the main scanning direction. The encoder is, e.g., an optical encoder.

A general optical encoder is constituted by fixing a reference (scale) having indices at a small interval in the main scanning direction to a printer main body. An index is read by a sensor on the carriage, and the moving position and speed of the carriage are detected by a sensor output signal. In general, the indices are printing position indices and are set as position information (space information) at a predetermined interval.

The index interval (position resolving power) desirably coincides with the actual printing resolution (printing interval). If the resolution becomes higher, as described above, a corresponding scale must be manufactured, and the sensitivity of the sensor for reading information from the scale must be increased, resulting in a high-cost encoder.

To decrease the encoder cost, a scale lower in resolving power than the actual printing resolution is adopted. Printing position information at higher resolution is generated by interpolation. The moving position of the carriage and driving of the printing head are controlled in accordance with the printing position information. In this case, only the range where the carriage moves at a constant speed is set as a printing region in order to ensure the precision of printing position information.

FIG. 4 is a graph showing the relationship between the carriage moving speed and the time. In the graph, the abscissa represents the time, and the ordinate represents the moving speed. As shown in this graph, the time required for the overall carriage movement is B, and the time during which the carriage moves at a constant speed is A. The time used for printing is only A out of the time B during which the carriage moves. The time (B−A) (acceleration/deceleration time) is idle in terms of printing.

This greatly influences even the size of the printer main body. That is, a region for accelerating/decelerating the carriage is required in the main scanning direction in addition to the printing region. The printer width in the main scanning direction increases.

To shorten the printing time, the speed in the constant-speed region must be increased, and the time necessary for acceleration/deceleration must be shortened. In this case, the acceleration/deceleration curve becomes steep, and large kinetic energy must be applied to the carriage as a target to be moved.

Supplying large energy requires a high-strength driving mechanism such as a motor. Electric energy (electric power) consumed by the driving mechanism increases. As a result, the driving mechanism becomes bulky and expensive, which is disadvantageous in terms of power consumption.

This problem is not confined to a printing apparatus such as a printer. The same problem occurs even in other electronic devices having a movable portion which moves reciprocally, such as a scanner and copying machine.

SUMMARY OF THE INVENTION

It is the first object of the present invention to provide a movement control apparatus capable of controlling the current position of a member to be driven with high precision even during acceleration/deceleration.

It is the second object of the present invention to provide a printing apparatus capable of controlling the current position of a member to be driven with high precision even during acceleration/deceleration.

It is the third object of the present invention to provide a movement control method capable of controlling the current position of a member to be driven with high precision even during acceleration/deceleration.

The first object is attained by a movement control apparatus according to the first aspect of the present invention comprising a scale having a plurality of indices at a predetermined interval, a sensor which is attached to a member to be driven along the scale and detects the indices, prediction means for predicting, on the basis of an output waveform of the sensor, a time until a next index is detected, and position signal generation means for generating a signal concerning a current position of the member on the basis of the predicted time.

The second object is attained by a printing apparatus according to the second aspect of the present invention comprising a scale which is attached to a guide shaft and has a plurality of indices at a predetermined interval, a sensor which is attached to a carriage which supports a printing head to be driven along the guide shaft and detects the indices, prediction means for predicting, on the basis of an output waveform of the sensor, a time until a next index is detected, and position signal generation means for generating a signal concerning a current position of the carriage on the basis of the predicted time, wherein the printing head is driven based on the position generation signal to perform printing even in a region where the carriage is accelerated/decelerated.

The third object is attained by a movement control method according to the third aspect of the present invention for controlling movement of a member to be driven by using a scale having a plurality of indices at a predetermined interval, and a sensor which is attached to the member to be driven along the scale and detects the indices, comprising the steps of predicting, on the basis of an output waveform of the sensor, a time until a next index is detected, and generating a signal concerning a current position of the member on the basis of the predicted time.

More specifically, according to the present invention, to control movement of a member to be driven by using a scale having a plurality of indices at a predetermined interval, and a sensor which is attached to the member to be driven along the scale and detects the indices, a time until the next index is detected is predicted on the basis of the output waveform of the sensor. Then, a signal concerning the current position of the member is generated on the basis of the predicted time.

The time until the next index is detected can be almost accurately predicted from the output waveform of the sensor along with detection of a scale index. This prediction can provide information about the current position of the member to be driven with a precision several times the interval of the scale index.

The position of the member which is being accelerated/decelerated can be controlled with high precision without setting a very small interval of the scale index.

Applying the present invention to a printing apparatus achieves high-quality printing even during acceleration/deceleration. The time during which no printing is done can be shortened to increase the printing speed. The length (width) of the printing apparatus in the scanning direction can be shortened to downsize the whole apparatus.

The position signal generation means preferably includes interpolation means for adding an interpolation signal every predetermined time interval within the time.

The prediction means preferably predicts the time by predetermined calculation using time intervals at which a plurality of indices are detected.

The sensor preferably detects the indices in a non-contact manner.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, the term "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Brief Description of a Printing Apparatus

Figure 5:
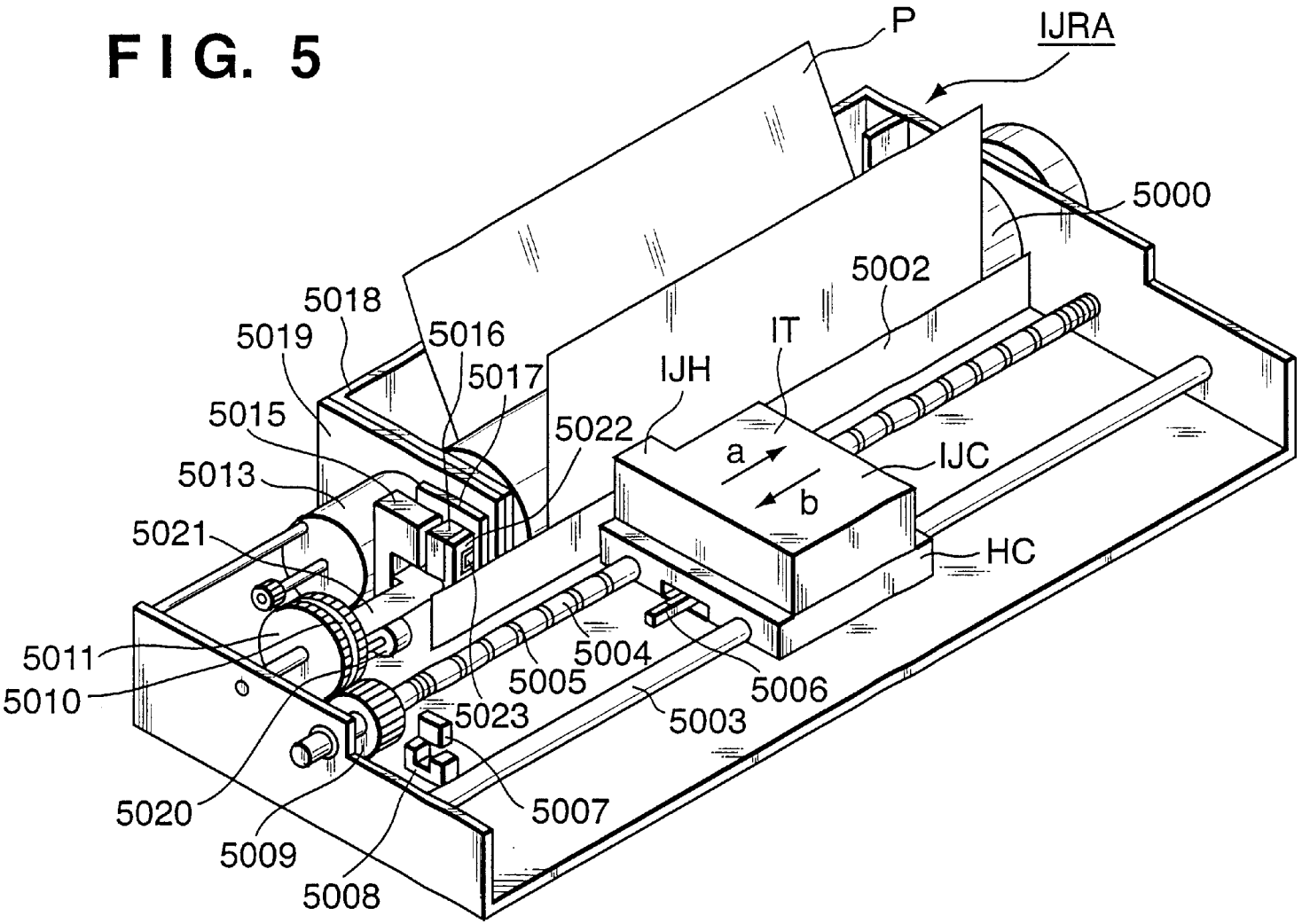
FIG. 5 is a perspective view showing an outer appearance of the construction of a printing apparatus according to the present invention.

FIG. 5 is a perspective view showing the outer appearance of an ink-jet printer IJRA as a typical embodiment of the present invention. Referring to FIG. 5, a carriage HC engages with a spiral groove 5005 of a lead screw 5004, which rotates via driving force transmission gears 5009 to 5011 upon forward/reverse rotation of a drive motor 5013. The carriage HC has a pin (not shown), and is reciprocally moved in directions of arrows a and b in FIG. 1. An integrated ink-jet cartridge IJC which incorporates a printing head IJH and an ink tank IT is mounted on the carriage HC.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and are used for switching, e.g., the rotating direction of motor 5013.

Reference numeral 5016 denotes a member for supporting a cap member 5022, which caps the front surface of the printing head IJH; and 5015, a suction device for suctioning ink residue through the interior of the cap member. The suction device 5015 performs suction recovery of the printing head via an opening 5023 of the cap member 5022. Reference numeral 5017 denotes a cleaning blade; and 5019, a member which allows the blade to be movable in a back-and-forth direction. These members are supported on a main unit support plate 5018. The shape of the blade is not limited to this, but any known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5004 when the carriage reaches the home-position side region. However, the present invention is not limited to this arrangement as long as desired operations are performed at known timings.

Description of a Control Arrangement

Next, the control structure for performing the printing control of the above apparatus is described.

Figure 6:
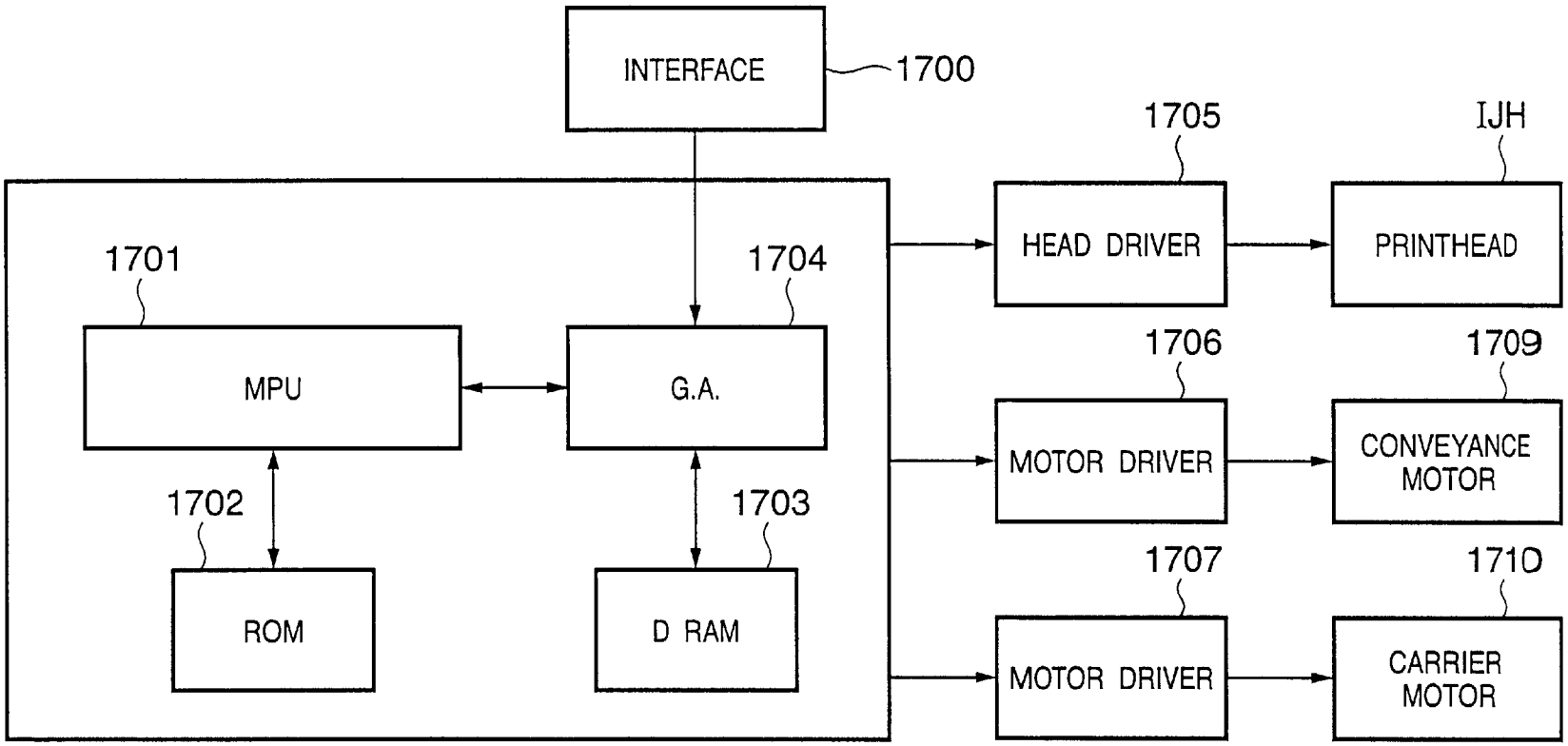
FIG. 6 is a block diagram showing an arrangement of a control circuit of the printing apparatus shown in FIG. 5.

FIG. 6 is a block diagram showing the arrangement of a control circuit of the ink-jet printer. Referring to FIG. 6 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G.A.) for performing supply control of print data to the printing head IJH. The gate array 1704 also performs data transfer control among the interface 1700, the MPU 1701, and the RAM 1703. Reference numeral 1710 denotes a carrier motor for shifting the printing head IJH in the main scanning direction; and 1709, a conveyance motor for conveying a paper sheet. Reference numeral 1705 denotes a head driver for driving the printing head; and 1706 and 1707, motor drivers for driving the conveyance motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Note that the ink tank IT and the printing head IJH are integrally formed to construct an exchangeable ink cartridge IJC; however, the ink tank IT and the printing head IJH may be separately formed such that when ink is exhausted, only the ink tank IT can be exchanged for a new ink tank.

Description of the Ink Cartridge

Figure 7:
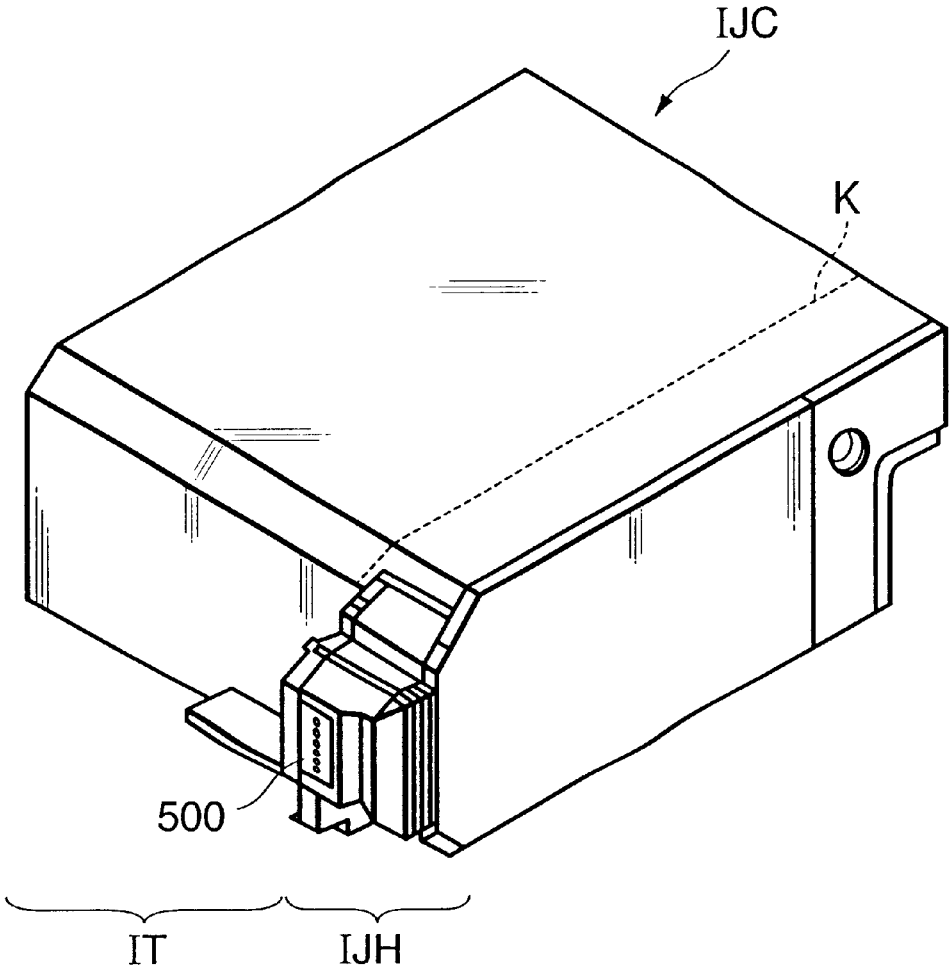
FIG. 7 is a perspective view showing an outer appearance of an ink cartridge of the printing apparatus shown in FIG. 5.

FIG. 7 is a perspective view showing the structure of the ink jet cartridge IJC where the ink tank and the head can be separated. As shown in FIG. 7 in the ink cartridge IJC, the ink tank IT and the printing head IJH can be separated along a line K. The ink cartridge IJC has an electrode (not shown) for receiving an electric signal supplied from the carriage HC side when it is mounted on the carriage HC. By the electric signal, the printing head IJH is driven as above, and discharges ink.

Note that in FIG. 7, numeral 500 denotes an ink-discharge orifice array. Further, the ink tank IT has a fiber or porous ink absorbing body. The ink is held by the ink absorbing body.

Movement Controller

A movement controller including an encoder in an ink-jet printer according to the embodiment will be explained.

Figure 1:
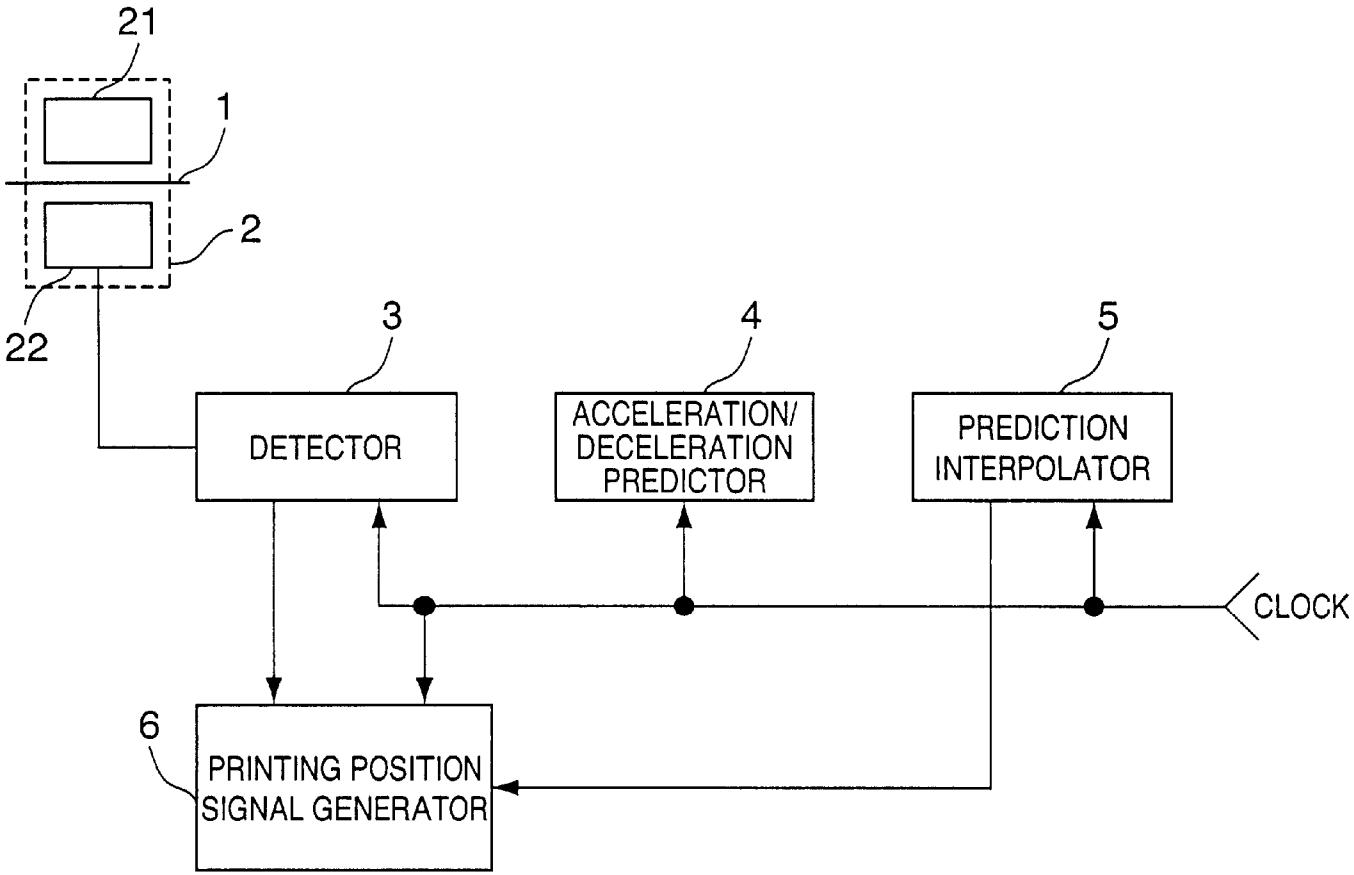
FIG. 1 is a block diagram showing the arrangement of a movement controller in a preferred embodiment of the present invention.

FIG. 1 is a schematic block diagram showing the arrangement of the movement controller in the embodiment. A scale 1 on which light-transmitting portions (slits) and non-transmitting portions are alternately formed as position information at a predetermined interval is fixed to a mechanism component or the like so as to pass through the detection region of a photosensor 2 attached to a carriage. Light from a light-emitting device 21 within the photosensor 2 passes through the transmitting portion of the scale to reach a light-receiving device 22 in the photosensor 2.

When the carriage moves, relative movement is effected between the photosensor 2 and the scale 1. The light-receiving device 22 receives light from the light-emitting device 21 via the transmitting portion of the scale 1 at a time interval corresponding to the relative moving speed. An output from the light-receiving device 22 is therefore a periodic signal corresponding to the relative moving speed. The encoder is made up of the scale 1 and the photosensor 2. In the following description, a signal from the encoder means a signal output from the light-receiving device 22.

A detector 3 extracts, e.g., edge information corresponding to the start of light reception from the periodic signal, and converts the extracted information into binary digital information. In this manner, a physical pattern recorded on the scale 1 is converted into electrical information, i.e., a digital signal whose time interval changes in accordance with the relative moving speed. More specifically, the time interval of this signal becomes smaller as the relative moving speed becomes higher.

The digital signal whose time interval changes from the detector 3 is sent to a printing position signal generator 6 via one path and an acceleration/deceleration predictor 4 via the other path. The acceleration/deceleration predictor 4 predicts the time up to reception of a signal corresponding to the next slit on the basis of signals which have been received from the detector 3 so far. The predicted time is converted into a clock count, which is output to a prediction interpolator 5.

The prediction interpolator 5 generates a number of interpolation signals corresponding to a resolving power necessary for printing until the detector 3 outputs a signal corresponding to the next slit. The prediction interpolator 5 sends the generated signals to the printing position signal generator 6. If the detector 3 outputs a signal corresponding to a slit, the printing position signal generator 6 directly outputs the received signals as printing position information. Until the detector 3 outputs a signal corresponding to the next slit, the printing position signal generator 6 outputs the signals from the prediction interpolator 5 as printing position information.

Figure 2:
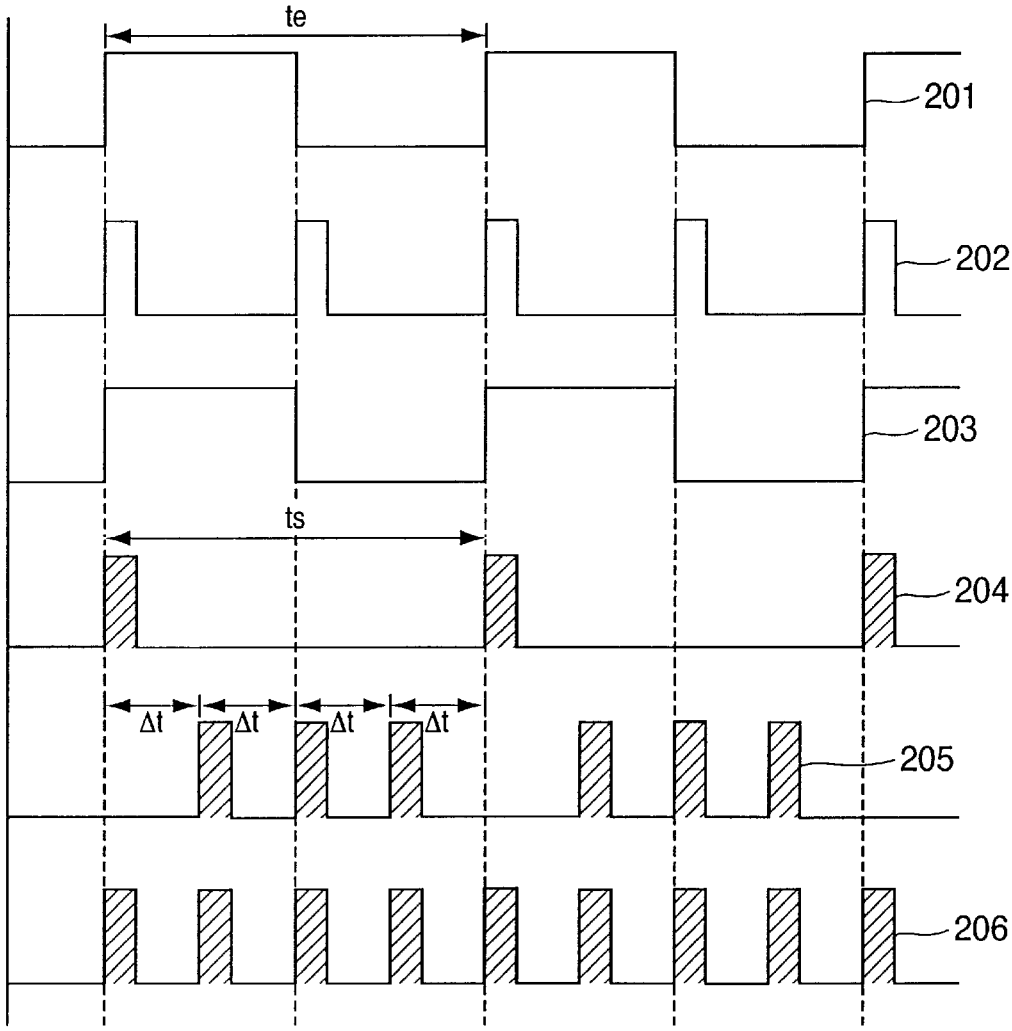
FIG. 2 is a timing chart showing the state of a signal from each unit of the movement controller in FIG. 1.

The operation of the movement controller according to the embodiment will be briefly described with reference to the timing chart of FIG. 2. FIG. 2 shows the state of a signal from each unit when the scale 1 and the photosensor 2 relatively move at a predetermined speed.

A signal waveform 201 represents an output signal from the encoder. The signal level is high when light is received via a slit portion, and low when light cannot be received due to a portion other than the slit.

A signal waveform 202 is output from the detector 3 when leading and trailing edges are detected from the signal 201. An edge detection method is a general method of ANDing an undelayed signal and a signal prepared by delaying the signal 201 by one clock after chatter removal.

A signal 203 is obtained by shaping the signal 201 into a rectangle. The signals 202 and 203 are ANDed to attain a signal 204 as a pulse wave corresponding to the start of light reception of the light-receiving device 22. A period ts of the signal 204 is equal to a period te of a signal from the encoder.

The signal 204 propagates through the acceleration/deceleration predictor 4 and prediction interpolator 5, resulting in an interpolation signal 205. The printing position signal generator 6 synthesizes the correct position signal 204 from the detector 3 and the interpolation signal 205 which is based on the predicted period and output from the prediction interpolator 5. The printing position signal generator 6 outputs the synthesized signal as a signal 206.

The operations of the acceleration/deceleration predictor 4 and prediction interpolator 5 will be described.

Figure 3:
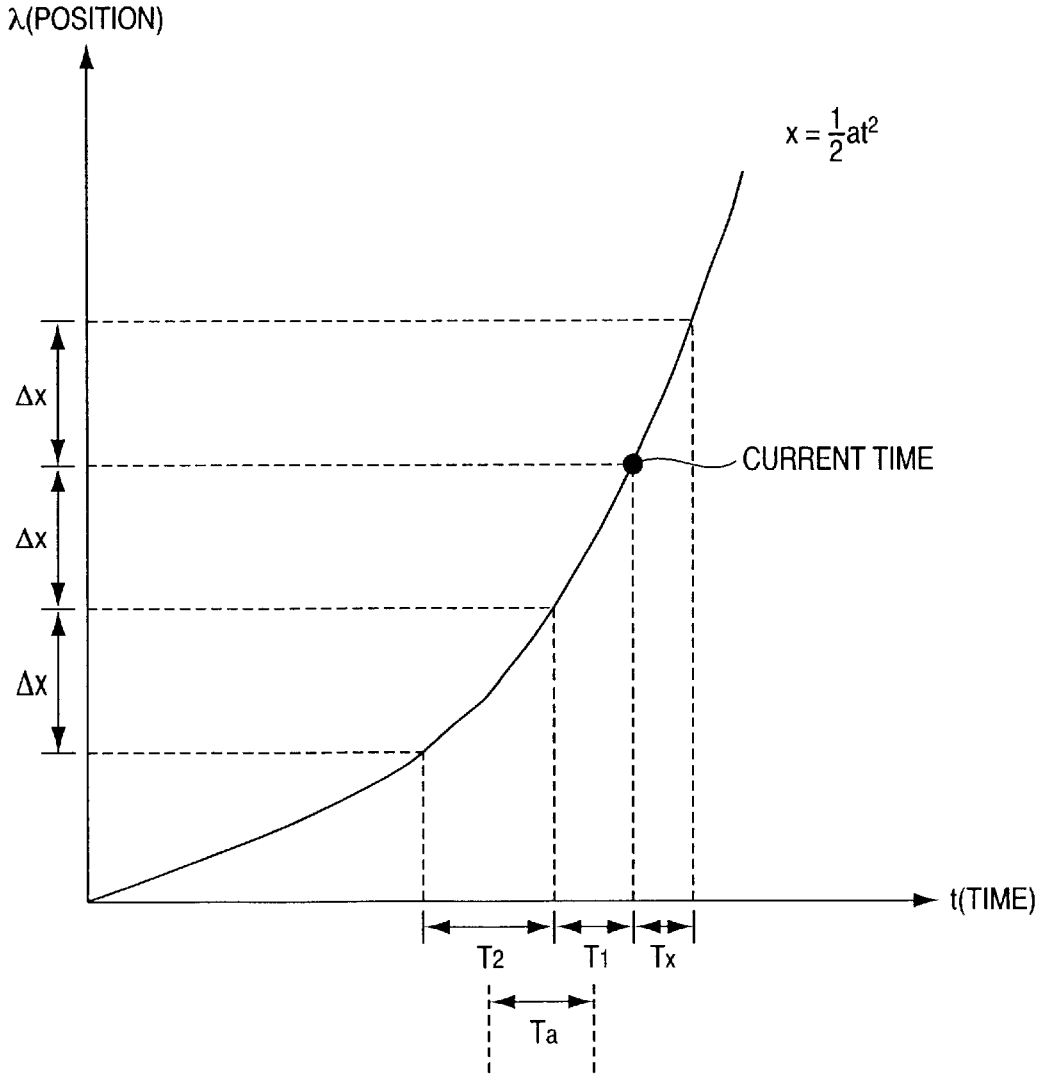
FIG. 3 is a graph showing the relationship between the time and the position when an object is accelerated and moved.
Figure 4:
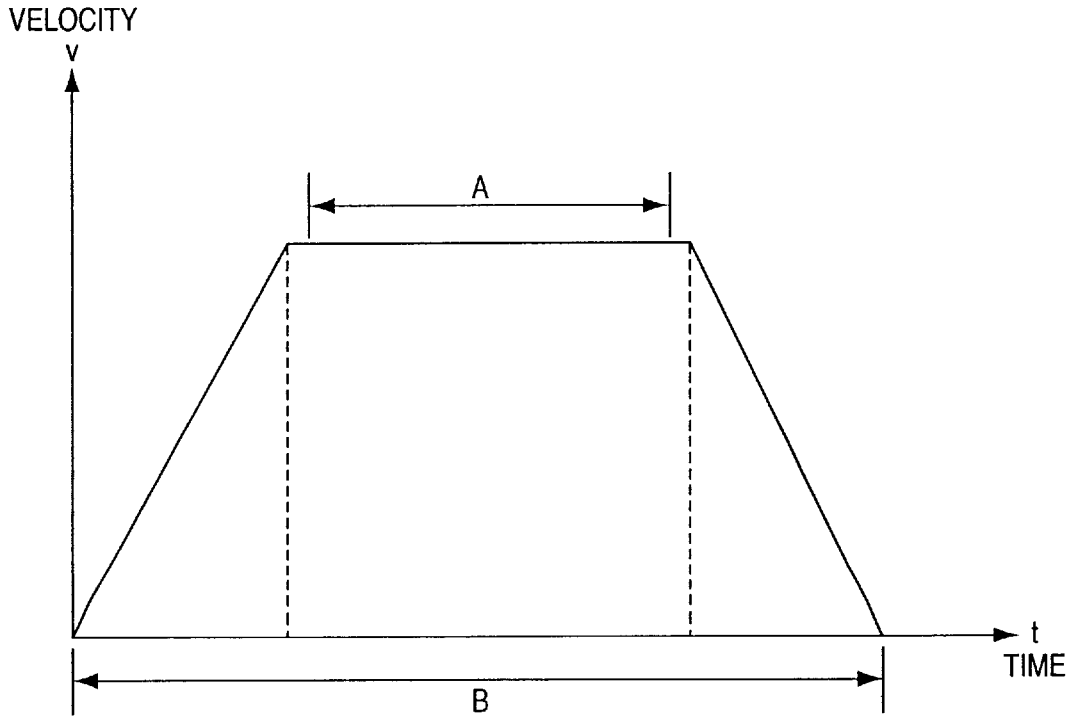
FIG. 4 is a graph showing the relationship between the carriage moving speed and the time.

The acceleration/deceleration predictor 4 will be explained. FIG. 3 is a graph showing the relationship between the position and the time when an object is accelerated and moved. Letting $x_0$ be the initial position, $v_0$ be the initial velocity, and a be the acceleration, a position x in general acceleration motion is given as a function of time t:

$$x=\tfrac{1}{2}(at^2)+v_0t+x_0$$

For descriptive convenience, assuming the initial position $x_0$ and the initial velocity $v_0$ to be 0, $$x=\tfrac{1}{2}(at^2)$$

Pieces of position information set on the scale are fixed at an equal interval. Lines at an equal interval Δx are drawn parallel to the x-axis on the graph of FIG. 3, and drawn down to the t-axis (time axis). Let R be the current time, $T_1$ be the time interval (period) between the current time and immediately preceding scale information, and $T_2$ be the time interval (period) between the second preceding scale information and the immediately preceding scale information. In practice, the interval Δx of the scale 1 is very small. For example, for 300 lpi (lines per inch), the interval Δx is about 84.7 μm. The velocity can be considered to change differentially.

A neighboring acceleration $a_0$ is calculated. The acceleration is expressed by a=dv/dt. Letting $v_2'$ be the average velocity of the period $T_2$, $v_1'$ be the average velocity of the period $T_1$, and $T_a$ be the difference between the barycenters of the two periods $T_1$ and $T_2$, $$a_0=(v_1-v_2)/T_a$$

This can be approximated by $(v_1'-v_2')/T_a$.

Since $v_1'$is the average velocity of the period $T_1$, $$v_1'=\Delta x/\Delta t=\Delta x/T_1$$

Similarly, the average velocity $v_2'$ of the period $T_2$ is $$v_2'=\Delta x/T_2$$

Accordingly, the neighboring acceleration $a_0$ is given by $$a_0=\Delta x/T_a\cdot(1/T_1-1/T_2) \quad (1)$$

$$T_a=\tfrac{1}{2}(T_1+T_2)$$

Then, the velocity at the current time R is calculated. A velocity $v_R$ at the current time is approximated by the neighboring acceleration $a_0$ into $$v_R=a_0(T_1/2)+v_1 \quad (2)$$

To obtain the velocity at the current time R as an average velocity $v_R'$ at the current time, letting $T_x$ be the next period which starts from the current time R, the average velocity $v_R'$ can be expressed by $$v_R'=2\cdot\Delta x/(T_1+T_x) \quad (3)$$

Assume that the velocity $v_R$ at the current time and the average velocity $v_R'$ at the current time are equal to each other. From equations (2) and (3), $$v_R=v_R=a_0(T_1/2)+v_1'=2\cdot\Delta x/(T_1+T_x) \quad (4)$$

Substituting equation (1) into equation (4) yields $$\Delta x/T_a\cdot(1/T_1-1/T_2)\cdot(T_1/2)+v_1'=2\cdot\Delta x/(T_1+T_x) \quad (5)$$

Equation (5) is solved for the next period $T_x$ to be predicted:

$$T_x=T_1(T_1^2+T_2^2)/(T_2^2+2T_1\cdot T_2-T_1^2) \quad (6)$$

The predicted value $T_x$ is represented by the known values $T_1$ and $T_2$ and can be approximately predicted.

$T_1$ and $T_2$ are pieces of time information. In this case, a clock having a period ($T_c$) much shorter than $T_1$ and $T_2$ is used as a clock input to the acceleration/deceleration predictor 4. Letting $N_1$ be the number of clocks during the period $T_1$, and $N_2$ be the number of clocks during the period $T_2$, $$T_1\approx N_1\cdot T_c,\ T_2\approx N_2\cdot T_c$$

Thus, $T_1$ and $T_2$ can be expressed by the clock period and the count. Equation (6) is rewritten by the number of clocks:

$$N_x=N_1(N_1^2+N_2^2)/(N_2^2 2N_1\cdot N_2-N_1^2) \quad (7)$$

The acceleration/deceleration predictor 4 is so constituted as to calculate a predicted value in accordance with either equation (6) or (7).

Equations (6) and (7) contain multiplication and division. If these equations are realized by hardware such as a logic circuit, the circuit scale becomes large; if these equations are realized by software, the arithmetic time becomes long.

From this, equation (6) is further approximated using $\delta T=T_2-T_1$. The denominator of equation (6) can be expressed by $$(T_2^2+2T_1\cdot T_2-T_1^2)=2T_1^2+4\delta T\cdot T_1+(\delta T)^2=2T_1^2(1+2\cdot\delta T/T_1+(\delta T/T_1)^2/2)$$

Considering $\delta T<<T_1$, this denominator is further approximated into $$(T_2^2+2T_1\cdot T_2+T_1^2)\approx 2T_1^2\ (1+2\cdot\delta T/T_1)$$

Similarly, the numerator of equation (6) is approximated into $$T_1(T_1^2+T_2^2)\approx 2T_1^3(1+2\cdot\delta T/T_1)$$

Therefore, equation (6) can be approximated into $$T_x \approx T_1 \cdot (1+\delta T/T_1)/(1+2\cdot\delta T/T_1) \quad (8)$$

$$= T_1(1+\delta T/T_1)(1+2\cdot\delta T/T_1)^{-1}$$

$$\approx T_1(1+\delta T/T_1)(1+2\cdot\delta T/T_1)$$

$$\approx T_1 - \delta T$$

Equation (8) can be constituted by only addition and subtraction, which can be easily realized by hardware or software.

Alternatively, equation (8) may be rewritten into $$T_x = T_1 - \delta T = T_1 - (T_2 - T_1) = 2\cdot T_1 - T_2 \quad (9)$$

Equation (9) may be expressed by the number of clocks, and N may be subtracted from a value calculated by doubling $N_1$(shifting $N_1$ by 1 bit).

The prediction interpolator 5 will be briefly explained. The prediction interpolator 5 equally divides, in accordance with a necessary resolving power, the time $T_x$ until next position information of the scale that is calculated by the acceleration/deceleration predictor 4 is obtained.

For example, if the resolving power must be four times that of the scale 1, $T_x$ is divided into ¼. More specifically, a time Δt for outputting interpolation data is $\Delta t = T_x/4$. Letting n be the count for Δt, $$n = N_x \cdot 1/4 \quad (10)$$

If the division number is even, division can be realized by bit shift. For ¼ in the above example, division can be achieved by two bit shift operations, which can be realized by a simple circuit arrangement. Hence, the scale 1 is preferably set to an even multiple of the minimum resolving power.

In this way, the prediction interpolator 5 generates the signal 205 in FIG. 2 by using a counter or the like on the basis of the time Δt (or the count n) for outputting interpolation data.

When first Δt is generated, the time taken to calculate Δt (or n) is preferably subtracted.

As described above, according to this embodiment, the acceleration/deceleration predictor and the prediction interpolator approximately predict a time until the next position information is obtained from an immediately preceding velocity and acceleration, and generate interpolation data. Even during acceleration/deceleration, the carriage position can be relatively accurately detected.

This enables high-quality printing even during acceleration/deceleration. The time during which no printing is done can be shortened to increase the printing speed. The length (width) of the printing apparatus in the scanning direction can be shortened to downsize the whole apparatus.

Other Embodiment

The above embodiment has exemplified an ink-jet printer for scanning the carriage which supports the printing head, and printing information. The present invention can be apparently applied to other types of serial printers.

Moreover, the present invention can be applied not only to printing apparatuses such as a printer, but also to other electronic devices having a scanning portion, such as a scanner and copying machine.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand and continuous types. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive ink from the apparatus main unit upon being mounted on the apparatus main unit, but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In this case, an ink may be situated opposite electrothermal transducers while being held in a liquid or solid state in recess portions of a porous sheet or through-holes, as described in Japanese Patent Laid-Open No. 54-56847 or 60-71260. In the present invention, the above-mentioned film boiling system is most effective for the above-mentioned inks.

Further, the object of the present invention can also be achieved by providing a storage medium storing program codes for performing the aforesaid processes in a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, or ROM, can be used for providing the program codes.

Furthermore, besides the aforesaid functions according to the above embodiments being realized by executing the program codes which are read by a computer, the present invention includes a case where an OS (operating system) or the like working in the computer performs a part of or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or entire processes in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A movement control apparatus comprising:

a scale having a plurality of indices at a predetermined interval;

a sensor which is attached to a member to be driven along said scale and detects the indices;

signal generating means for generating pulse signals in response to outputs from said sensor, in which a period of the pulse signals corresponds to a moving speed of the member; and prediction means for predicting, within an acceleration or deceleration region of a movement of the member, a period until a next pulse signal corresponding to a next index, based on a prior period and a period before the prior period of the pulse signals in accordance with a predetermined calculation.

2. The apparatus according to claim 1, further comprising interpolation means for adding an interpolation pulse signal for every period of the pulse signals.

3. The apparatus according to claim 1, wherein the predetermined calculation is expressed by an equation:

$$Tx=T1(T1^2+T2^2)/(T2^2+2T1\cdot T2-T1^2),$$

where Tx is the period until the next pulse, T1 is the prior period and T2 is the period before the prior period.

4. The apparatus according to claim 3, wherein the equation is approximated by an equation:

$$Tx=2T1-T2,$$

assuming $T2-T1<<T1$.

5. A printing apparatus comprising:

a scale which is attached to a guide shaft and has a plurality of indices at a predetermined interval;

a sensor which is attached to a carriage which supports a printing head to be driven along the guide shaft and detects the indices;

signal generating means for generating pulse signals in response to outputs from said sensor, in which a period of the pulse signals corresponds to a moving speed of the carriage;

prediction means for predicting, within an acceleration or deceleration region of a movement of the carriage, a period until a next pulse signal corresponding to a next index, based on a prior period and a period before the prior period of the pulse signals in accordance with a predetermined calculation;

interpolation means for adding an interpolation pulse signal for every period of the pulse signals; and control means for controlling a movement of the carriage on the basis of at least one of the pulse signals generated by said signal generation means and said interpolation means.

6. The apparatus according to claim 5, wherein the predetermined calculation is expressed by an equation:

$$Tx=T1(T1^2+T2^2)/(T2^2+2T1\cdot T2-T1^2),$$

where Tx is the period until the next pulse, T1 is the prior period and T2 is the period before the prior period.

7. The apparatus according to claim 6, wherein the equation is approximated by an equation:

$$Tx=2T1-T2,$$

assuming T2−T1<<T1.

8. A movement control method of controlling movement of a member to be driven by using a scale having a plurality of indices at a predetermined interval, and a sensor which is attached to the member to be driven along the scale and detects the indices, comprising the steps of:

generating pulse signals in response to outputs from the sensor, in which a period of the pulse signals corresponds to a moving speed of the member; and predicting, within an acceleration or deceleration region of a movement of the member, a period until a next pulse corresponding to a next index, based on a prior period and a period before the prior period of the pulse signals in accordance with a predetermined calculation.

9. The movement control method according to claim 8, further comprising the step of adding an interpolation pulse signal for every period of the pulses.

* * * * *

UNITED STATES PATENT AND TRADEMARK OFFICE

CERTIFICATE OF CORRECTION

PATENT NO. : 6,742,856 B2
DATED : June 1, 2004
INVENTOR(S) : Tatsumi

It is certified that error appears in the above-identified patent and that said Letters Patent is hereby corrected as shown below:

Column 7,
Line 62, "$v_1$'is" should read -- $v_1$' is --.

Column 8,
Line 10, "$v_R=a_0(T_1/2)+v_1$" should read -- $v_R=a_0(T_1/2)+v_1$' --.
Line 22, "$v_R=v_R=a_0(T_1/2)+v_1'=2\cdot\Delta x/(T_1+T_x)$" should read -- $v_R=v_R'=a_0(T_1/2)+v_1'=2\cdot\Delta x/(T_1+T_x)$ --.
Line 45, "$N_x=N_1(N_1^2+N_2^2)/(N_2^2 2N_1\cdot N_2-N_1^2)$" should read -- $N_x=N_1(N_1^2+N_2^2)/(N_2^2+2N_1\cdot N_2-N_1^2)$ --.

Signed and Sealed this

Eighteenth Day of January, 2005

JON W. DUDAS
*Director of the United States Patent and Trademark Office*